US011142866B2

(12) United States Patent
Rieger

(10) Patent No.: US 11,142,866 B2
(45) Date of Patent: Oct. 12, 2021

(54) TRIANGLE QUILTING TEMPLATE

(71) Applicant: Keril Rieger, Madison, AL (US)

(72) Inventor: Keril Rieger, Madison, AL (US)

( * ) Notice: Subject to any disclaimer, the term of this patent is extended or adjusted under 35 U.S.C. 154(b) by 89 days.

(21) Appl. No.: 16/665,109

(22) Filed: Oct. 28, 2019

(65) Prior Publication Data

US 2020/0056324 A1 Feb. 20, 2020

Related U.S. Application Data

(60) Continuation-in-part of application No. 29/645,874, filed on Apr. 30, 2018, now abandoned, which is a division of application No. 29/551,996, filed on Jan. 19, 2016, now Pat. No. Des. 816,321.

(51) Int. Cl.

| | |
|---|---|
| ***B43L 7/033*** | (2006.01) |
| ***D06H 7/02*** | (2006.01) |
| ***D06H 1/00*** | (2006.01) |

(52) U.S. Cl.

CPC ..... *D06H 7/02* (2013.01); *B43L 7/033* (2013.01); *D06H 1/00* (2013.01)

(58) Field of Classification Search

CPC . D06H 7/02; D06H 1/00; B43L 7/033; A41H 3/00

USPC ..... 33/565, 566

See application file for complete search history.

(56) References Cited

U.S. PATENT DOCUMENTS

| | | | | |
|---|---|---|---|---|
| 4,930,382 | A * | 6/1990 | Collins | A41H 3/00 33/17 R |
| 5,557,996 | A | 9/1996 | Reber et al. | |
| 6,276,070 | B1 * | 8/2001 | Hawley | B43L 7/033 33/1 G |
| D549,954 | S | 9/2007 | Jirak | |
| 7,281,337 | B1 | 10/2007 | Oehlke et al. | |
| 7,730,842 | B1 | 6/2010 | Sebrow | |
| 7,854,073 | B1 | 12/2010 | Webb | |
| D640,941 | S | 7/2011 | Tucker | |
| 8,261,680 | B2 * | 9/2012 | Oe | D05B 97/02 112/475.08 |
| 8,397,396 | B2 | 3/2013 | Nethery | |
| 8,499,470 | B1 * | 8/2013 | Hilton | B43L 13/205 33/562 |
| 10,781,545 | B2 * | 9/2020 | Massey | D05B 97/12 |
| 2013/0068148 | A1 * | 3/2013 | Ragan | D05B 91/06 112/475.08 |
| 2014/0099159 | A1 * | 4/2014 | Maunder | A63H 33/105 403/294 |
| 2016/0279819 | A1 * | 9/2016 | McCormick | B26B 25/005 |
| 2018/0298537 | A1 | 10/2018 | Kennedy et al. | |
| 2019/0127898 | A1 * | 5/2019 | Ritter | A41H 3/06 |
| 2020/0039103 | A1 * | 2/2020 | Nabity | D06H 7/00 |

(Continued)

*Primary Examiner* — Yaritza Guadalupe-McCall
(74) *Attorney, Agent, or Firm* — Cynthia R. Wright

(57) ABSTRACT

The Triangle Quilting Template is a template utilized by quilters to fabricate triangularly-shaped quilting blocks. The Triangle Quilting Template comprises two templates: a trapezoid shaped template and a template with a triangular shape. A quilter utilizes the templates to cut three trapezoid-shaped fabric pieces from the trapezoid-shaped template and a single fabric piece with a triangular shape from the template with a triangle shape. These four fabric pieces are sewn together to create a unique triangle-shaped quilting block. A number of triangle-shaped quilting blocks may be sewn together to create a quilt.

3 Claims, 6 Drawing Sheets

(56) References Cited

U.S. PATENT DOCUMENTS

| | | | | |
|---|---|---|---|---|
| 2020/0056324 | A1* | 2/2020 | Rieger | A41H 3/00 |
| 2020/0131680 | A1* | 4/2020 | Massey | D05B 97/12 |
| 2021/0123175 | A1* | 4/2021 | Singer-Snyder | D05B 97/12 |
| 2021/0241223 | A1* | 8/2021 | Ritter | G06Q 10/0832 |

* cited by examiner

TRIANGLE QUILTING TEMPLATE

CROSS-REFERENCE TO RELATED APPLICATIONS

This application claims priority to the following U.S. patent applications: Design application Ser. No. 29/645,874, filed Apr. 30, 2018, and Design application Ser. No. 29/551,996, filed on Jan. 1, 2016. The '874 application is a continuation-in-part application of the '996 application.

DISCLOSURE REGARDING PRIOR DISCLOSURES BY THE INVENTOR OR A JOINT INVENTOR

The inventor has not disclosed this invention prior to the filing of this non provisional application.

BACKGROUND OF THE INVENTION

(1) Field of the Invention

This device is a template that may aids users in fabricating individual fabric pieces, or quilting blocks. The template that indicates the location for sewing and cutting individual fabric pieces, or quilting blocks. The individual quilt blocks may be sewn together to create a quilt block pattern. The quilt block pattern may be sewn with other quilt block patterns to create the top layer of a quilt, or quilted object. The top layer may then be joined with batting and backing to form a quilt, or quilted object.

(2) Disclosure of the Prior Art

A number of quilting tools or templates are disclosed in the prior art. Quilting tools are utilized to allow a quilter to precisely cut fabric having differing shapes, color, design, and texture, which are then sewn into fabric pieces to form a block having a particular design. The individual blocks are sewn together to creating a beautiful and artistic pattern that forms the cover of a guilt. New quilting patterns are developed to express artistic creation and variety.

Hawley (U.S. Pat. No. 6,276,070 B1) discloses a quilting template with a number of imprinted guidelines allowing the cutting off of a portion of a fabric strip resulting in a trapezoidal fabric pattern. Some of the trapezoidal shapes may be sewn together in the form of a triangle, but this device can not be utilized to create the pattern formed using the device herein.

Oehlke et al. (U.S. Pat. No. 7,281,337 B1) discloses a quilting template comprising a trapezoid. The device of Oehlke et al. indicates where a quilter should cut and sew two fabric pieces to form a square composed of two right angle triangles arranged and sewn along their hypotenuse. The device of Oehlke et al. would not enable a quilter to form the pattern produced utilizing the Triangle Quilting Template. Quilts formed from right angles joined at their hypotenuse sides are common and well-known. Today, quilting has become an art form with quilters wanting unusual, eye-catching patterns.

BRIEF SUMMARY OF THE INVENTION

This device comprises two quilting templates that when used to create a triangle pattern for quilting. The two quilting templates are plate pieces that are laid upon fabric to be cut. One quilting template is formed into a triangle, and the one quilting template is formed into a trapezoid. One fabric piece is cut using the triangle quilting template, and three pieces are cut using the trapezoid. The four cut fabric pieces are assembled into a triangle pattern and sewn together. A number of the triangle patterns may be assembled to form a quilt or other cloth.

BRIEF DESCRIPTION OF THE DRAWINGS

The invention is described in detail below with reference to the appended drawings.

FIG. 1 depicts the Triangle Quilting Template and the three quilting pieces that made be made therefrom.

FIG. 2 depicts a top view of the trapezoid template.

FIG. 3 shows an angled side view of FIG. 2.

FIG. 4 shows the triangle template and the piece of fabric cut utilizing the triangle template.

Figure 5:
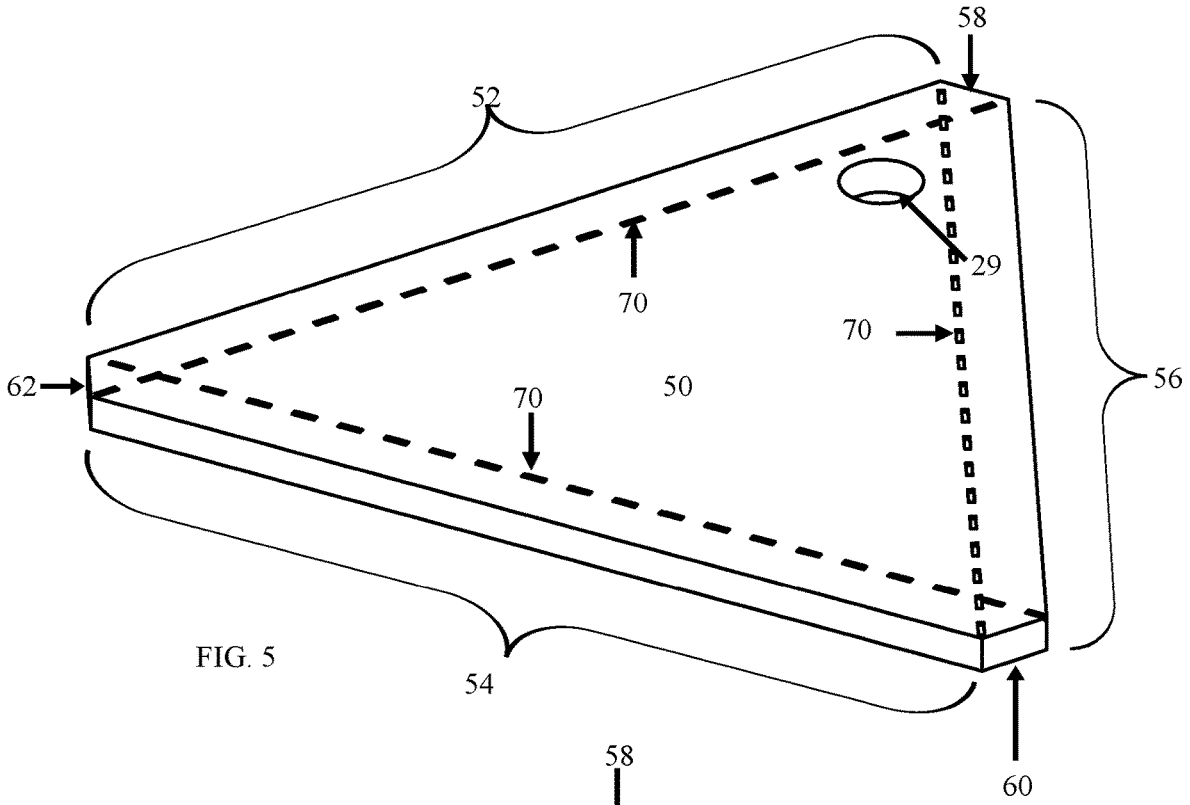
Figure 6:
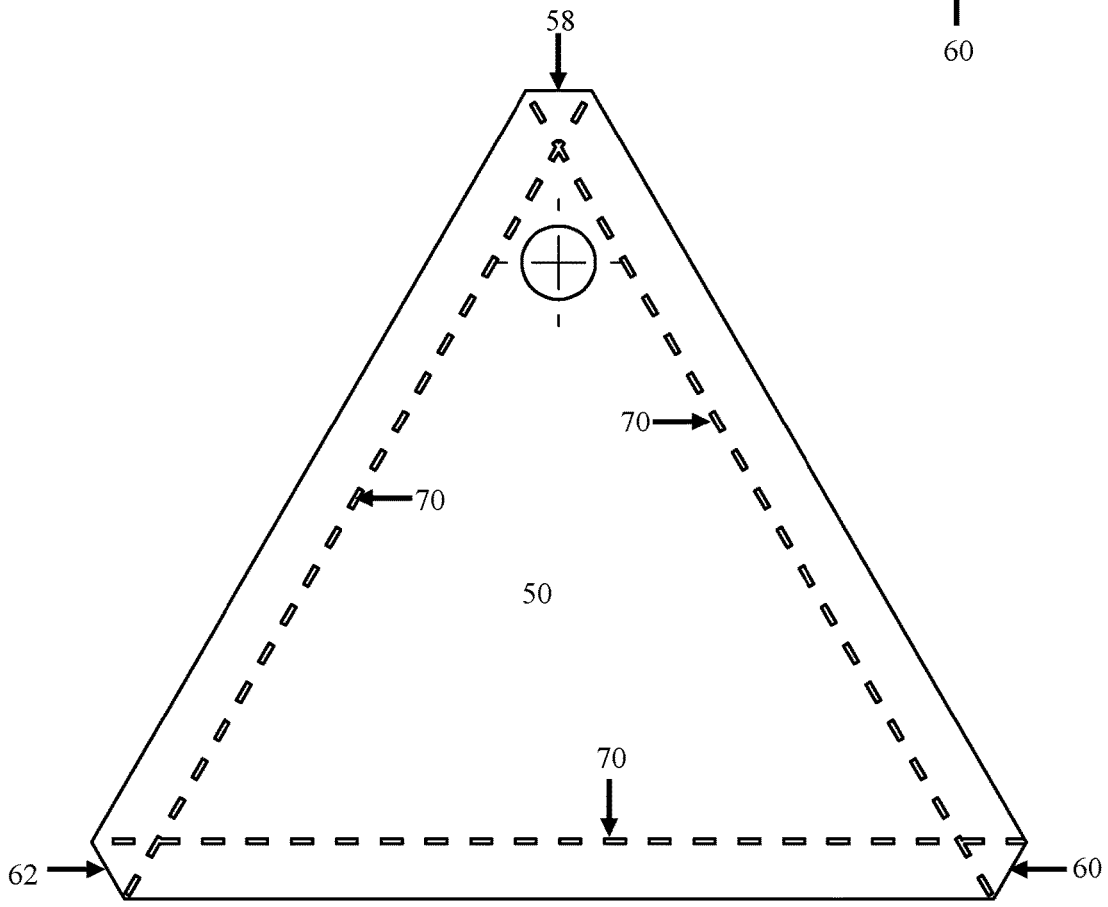

An angled, top view of the triangle template is depicted in FIG. 5, and a top view of the triangle template is shown in FIG. 6.

Figure 7:
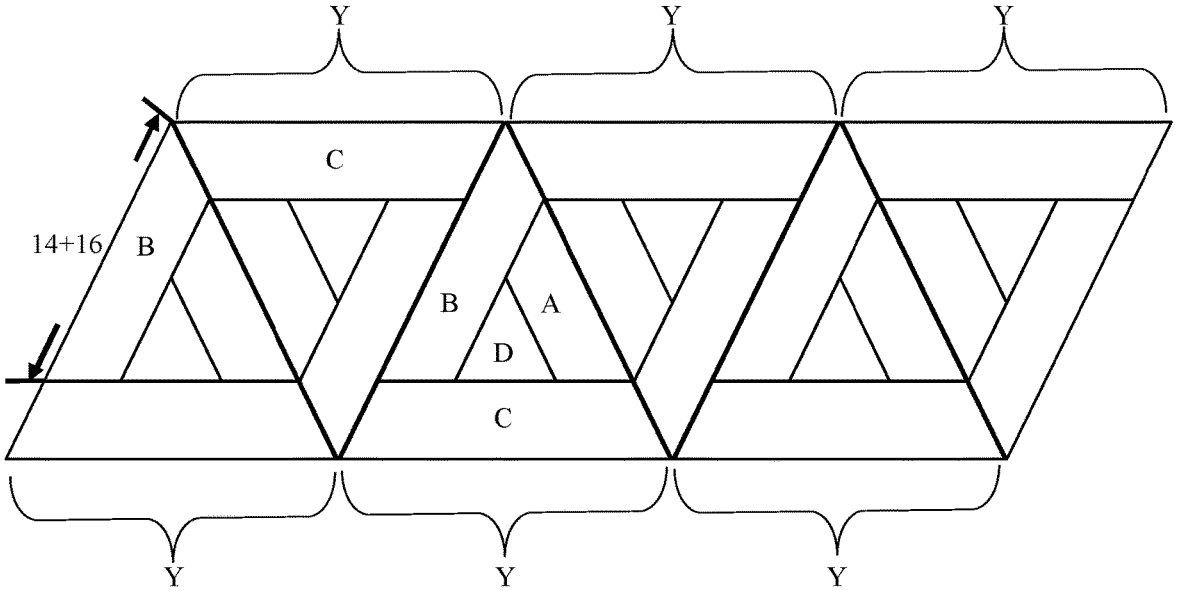

A top, angled view of six patterns produced utilizing the Triangle Quilting Template sewn together is shown in FIG. 7, wherein each of the six patterns comprises three pieces of fabric cut using the trapezoid and a single piece of fabric cut utilizing the triangle template.

Figure 8:
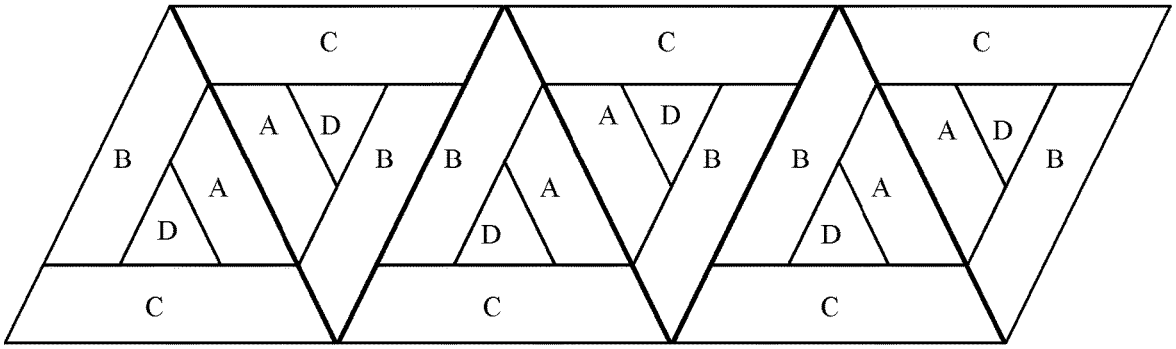

FIG. 8 depicts a top view of FIG. 7.

DETAILED DESCRIPTION OF THE INVENTION

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extent that any numerical values or other specifics of materials, etc., are provided herein, they are to be construed as exemplifications of the inventions herein, and the inventions are not to be considered as limited thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one, or an embodiment in the present disclosure, can be, but not necessarily, references to the same embodiment; and, such references mean at least one of the embodiments.

Reference in this specification to "one embodiment' or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same term can be said in more than one way.

Consequently, alternative language and synonyms may be used for any one or more of the terms discussed herein, or is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

The device herein comprises two quilting templates, a trapezoid template and a triangle template, utilized to cut certain shaped pieces of fabric. The pieces of fabric are then assembled into a triangular shaped pattern and sewn together into a block. Multiple blocks of fabric maybe sewn together to form a quilt top or other cloth, such as a coat or scarf, etc.

Figure 1:
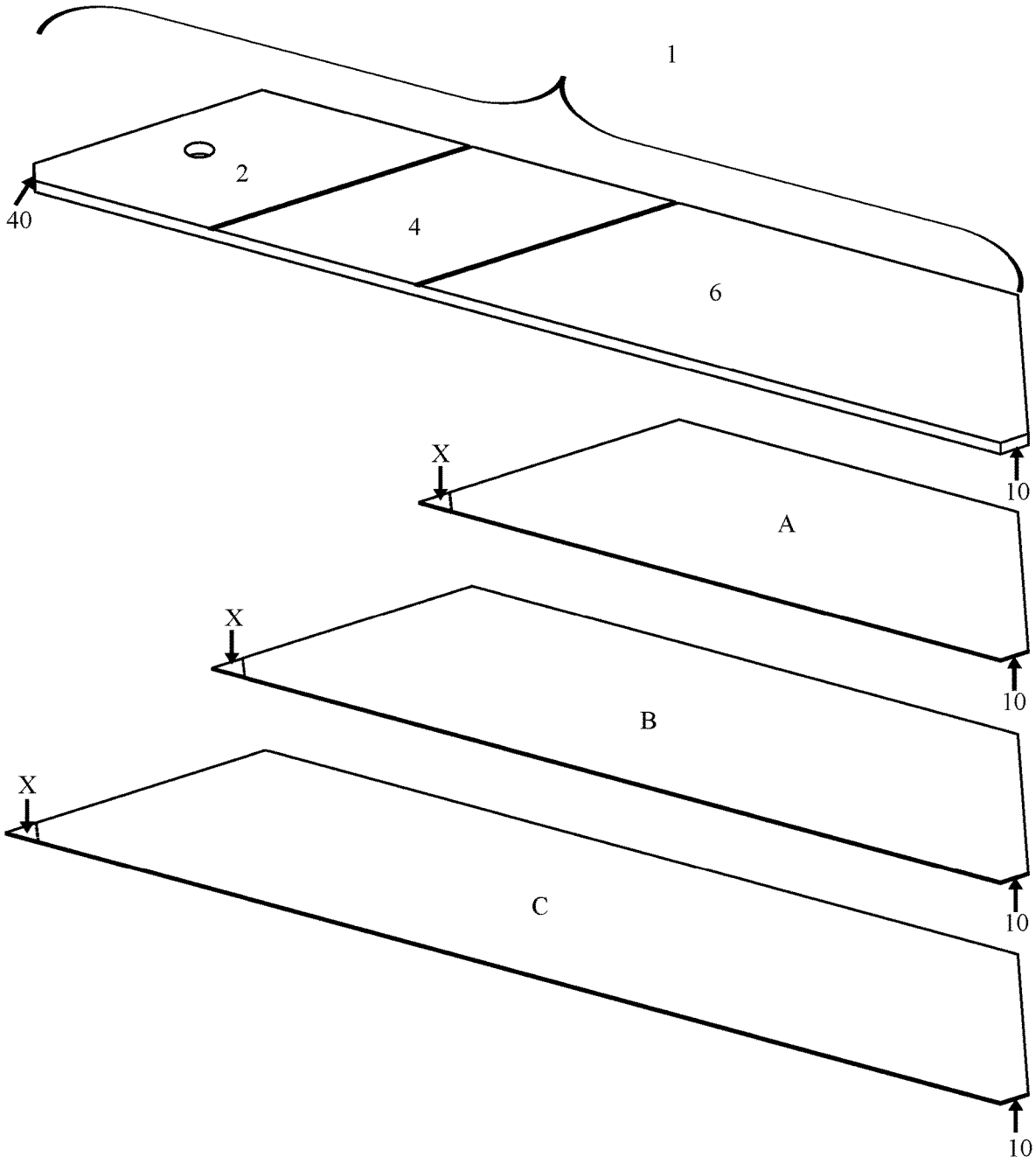
FIGS. 1 through 8 depict the Triangle Quilting Template. In the Figures.

Trapezoid template 1 of the Triangle Quilting Template is shown in FIG. 1. Trapezoid template 1 comprises sections 2, 4, and 6. Trapezoid template 1 is utilized to form fabric pieces A, B, and C. Fabric pieces A, B, and C are utilized to form the outer perimeter of a triangle pattern block. Blunt edge 10 may be ⅛" to ¼". Blunt edge 10 may be used to fold over the section 6 when each fabric piece A, B, and C is sewn to another fabric piece. This allows the edge of Section 6 to be folded and iron-pressed open so that a flat seam is created, and the quilted pattern block appears flat and smooth when the quilt is assembled.

Fabric piece A is produced from section 6. Fabric piece B is produced utilizing sections 4 and 6, while fabric piece C is produced using sections 2, 4, and 6. Area X is that portion of each fabric piece that may be cut from the fabric piece so that the edges of a fabric piece may be folded beneath each said piece after sewing the fabric piece to another fabric piece so that the quilted pattern block appears flat and smooth when the quilt is assembled. Note area X is the area of fabric on fabric piece C that is removed when template 1 is traced to include blunt edge 40.

Figure 2:
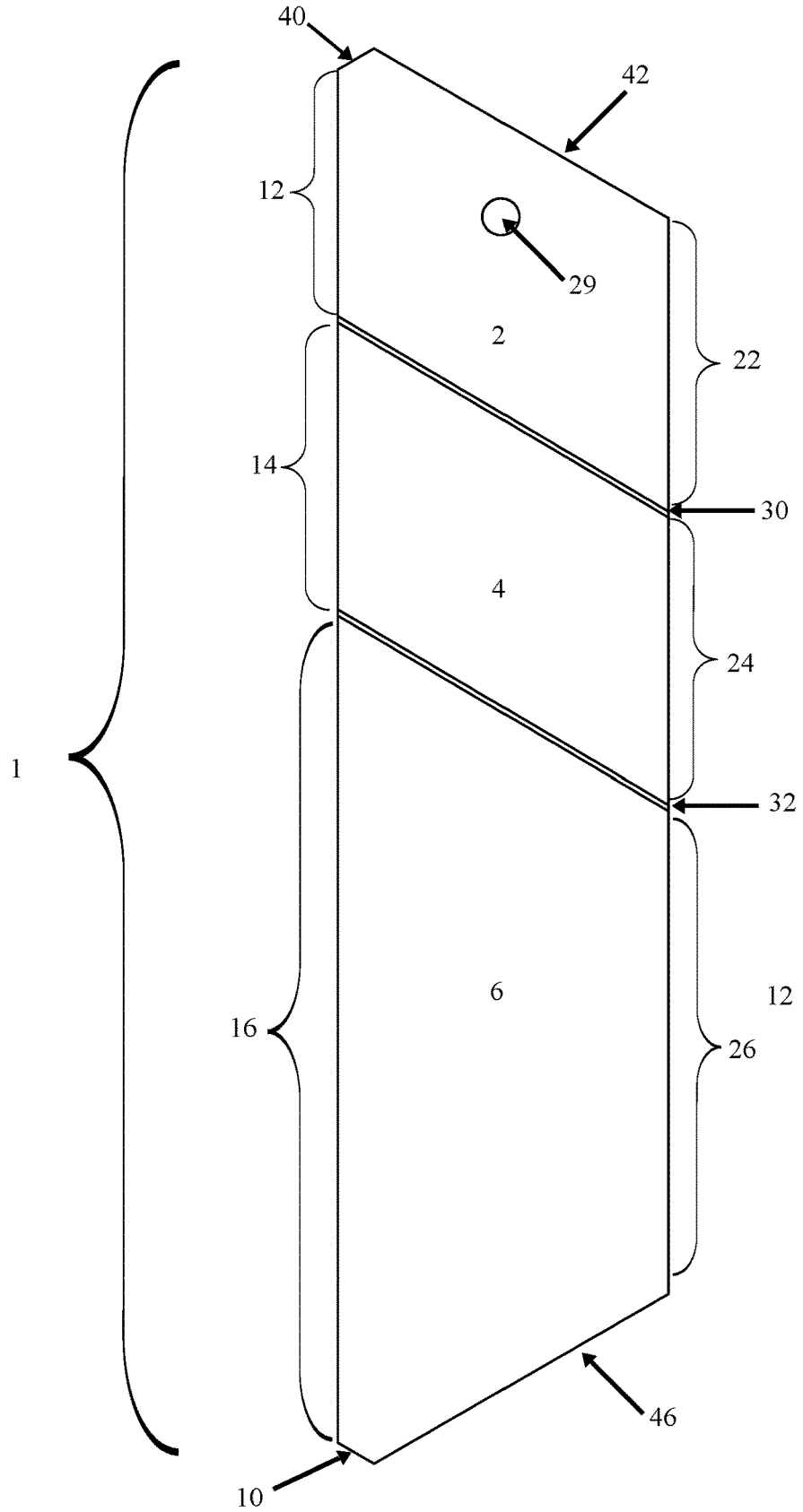

FIG. 2 depicts a top view of the trapezoid template 1. The outer perimeter of trapezoid 1 comprises a trapezoid shape with straight edges 22, 24 and 26 running parallel to blunt edge 40, straight edges 12, 14, 16, and blunt edge 10, wherein the outer perimeter length, or combined length of blunt edge 40, straight edges 12, 14, 26, and blunt edge 10 is more than the outer perimeter length of the combined length of straight edges 22, 24, and 26. Straight edges 42 and 46 connect the outer perimeter length, or combined length of blunt edge 40, straight edge 12, 14, 16, and blunt edge 10 with the outer perimeter length of the combined length of straight edge 22, 24, and 26.

Trapezoid template 1 comprises three sections: 2, 4, and 6. Section 2 is formed from straight edge 42, blunt edge 40, straight edge 12, guideline 30, and straight edge 22. Section 2 may optionally include opening 29 that enables trapezoid template 1 to be hung on a nail or positioned on a ring. Blunt edge 40 may be ⅛" to ¼" so that straight edge 42 may be folded onto the backside of section 2 after section 2 is sewn onto the quilting block. Straight edges 42, 12, and 22, blunt edge 40, and guideline 30 are used to draw section 2 onto fabric so that section 2 may be cut from fabric that is being used to create blocks of a quilt.

Section 4 of trapezoid template 1 is formed from guideline 30, straight edge 14, guideline 32, and straight edge 24. A user traces or draws the outline of section 4 unto fabric so that section 4 may be cut from fabric that is being used to form a portion of a quilt block. It is anticipated that a user will use one fabric to form section 2 and a different fabric to form section 4 so that the color, design, and/or texture of the quilting block will vary, enhancing the artistic appeal of the quilt.

Section 6 of trapezoid template 1 is formed from guideline 32, straight edge 16, blunt edge 10, straight edge 46 and straight edge 26. Section 6 may be cut from fabric that differs from the fabric used to fabricate sections 2 and 4 so that the color, design, and/or texture of the quilt produced will have a variety of color, and be more creative and artistic.

Figure 3:
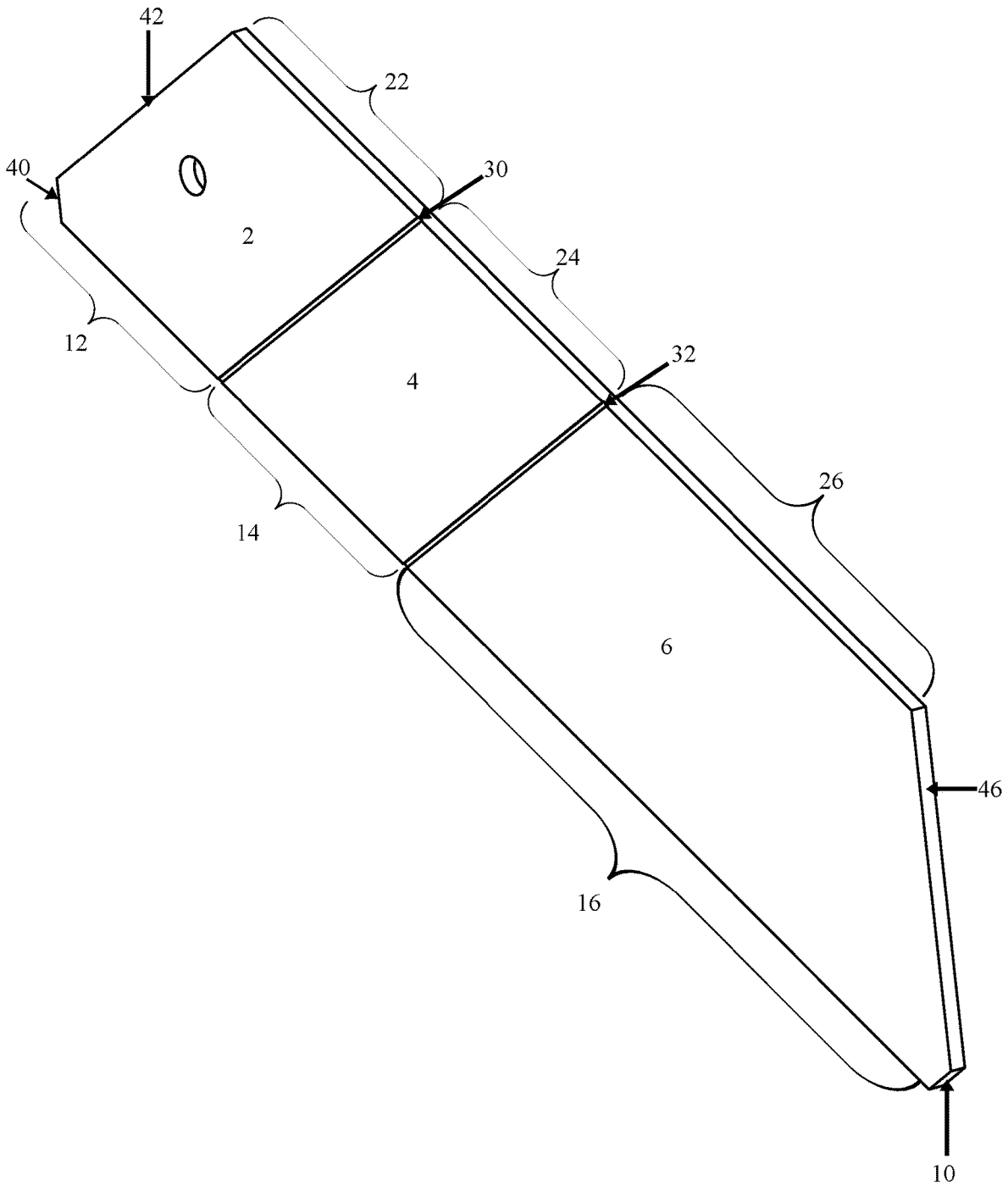

FIG. 3 depicts an angled, side view of FIG. 2. Note that straight edges 46, 26, 24, 22, and blunt edge 10 have a depth that allows a user to easily manipulate the template and to allow a user to easily mark the outer dimensions by running a fabric pencil along the edge. Straight edges 42, 12, 14, 16, and blunt edge 40 also have a depth (not shown) that facilitates its use. Guidelines 30 and 32 may be scored into the template to allow a user to easily and smoothly run a fabric pencil along said guideline while marking fabric pieces to be cut. Additionally, guidelines 30 and 32 may be utilized to align a pair of scissors while cutting fabric pieces from fabric.

Figure 4:
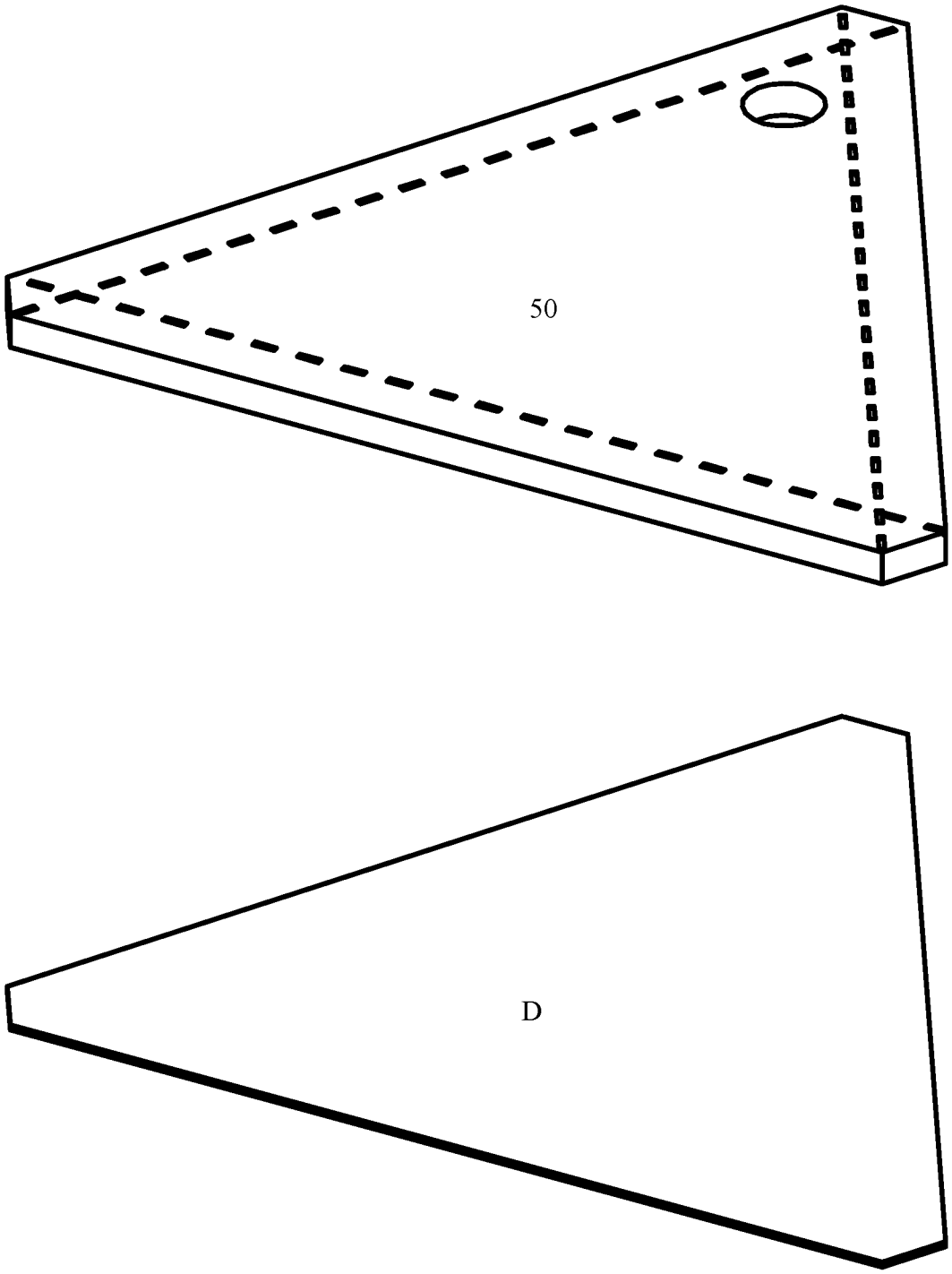

FIG. 4 depicts triangle fabric piece D which was cut from triangle template 50, shown above fabric piece D. One fabric piece D is sewn to each of the following fabric pieces: an A, a B, and a C, to make a single pattern block. Triangle template 50 is shown in both FIGS. 5 and 6. An angled, top view of triangle template 50 is shown in FIG. 5. Sew lines 70 indicate where a user may sew fabric piece D (shown in FIG. 4). Once the user sews along sew lines 70, the user may flip the sewn fabric pieces onto over and iron flat all fabric seams so that the quilt block will appear flat and smooth. Triangle template 50 may include opening 29, which may be used to hang the template upon a nail or to place it on a ring. Triangle template 50 may be an equilateral triangle wherein straight edges 52, 54, and 56 are of equal length. Blunt edges 58, 60, and 62 may be utilized to iron flat seams created when fabric piece D (shown in FIG. 4) is sewn to other fabric pieces. FIG. 6 depicts the triangle template 50 from the top. Blunt edges 58, 60, and 62 may be cut before sewing fabric pieces to fabric piece D (shown in FIG. 4) at sew lines 70, which may be drawn onto fabric piece D with a fabric pencil.

FIGS. 7 and 8 depict the arrangement of six quilting blocks Y sewn together. A single quilting block is labeled in FIG. 7. Note fabric piece D is centered within fabric pieces B, C, and D. FIG. 8 depicts all six quilting blocks wherein each fabric piece is labeled. Note, Fabric piece C is longer than fabric piece B, which is longer than fabric piece A. And, fabric pieces A, B, and C surround fabric piece D forming a triangle.

I hereby claim:

1. A quilting tool for cutting fabric pieces comprising:

a first template having an equilateral triangle shape, wherein the first template comprises three equal exterior edges providing a first fabric cutting guide for the shape and dimensions of a first fabric piece; wherein the first fabric piece has an equilateral triangle shape;

a second template having an isosceles trapezoid shape, wherein the second template comprises four exterior edges providing a second fabric cutting guide for the shape and dimensions of a second fabric piece; wherein the second fabric piece is an isosceles trapezoid; wherein the second template comprises a first straight edge and a second straight edge that run parallel to each other, wherein the first straight edge is longer than the second straight edge; further comprising two straight edges that connect the first straight edge to the second straight edge, wherein the second template further comprises a first fabric marking guide cut into a surface of the second template providing for a third fabric cutting guide for the shape and dimensions of a third fabric piece, wherein the third fabric piece is a second isosceles trapezoid; wherein the third fabric cutting guide runs along a first segment of the first straight edge to the first fabric marking guide, along the first fabric marking guide to a first segment of the second straight edge, along the first segment of the second straight edge to one of the two straight edges, along one of the two straight edges to the first segment of the first straight edge forming an isosceles trapezoid; wherein the length of the first segment of the first straight edge is greater than the length of the first segment of the second straight edge; wherein the third fabric piece is smaller than the second fabric piece;

wherein the second template further comprises a second fabric marking guide cut into a surface of the second template providing for a fourth fabric cutting guide for the shape and dimensions of a fourth fabric piece, wherein the fourth fabric piece is a third isosceles trapezoid; wherein the fourth fabric cutting guide runs along a second segment of the first straight edge to the second fabric marking guide, along the second fabric marking guide to a second segment of the second straight edge, along the second segment of the second straight edge to one of the two straight edges, along one of the two straight edges to the second segment of the first straight edge forming an isosceles trapezoid; wherein the length of the second segment of the first straight edge is less than the length than the first segment of the first straight edge; wherein the length of the second segment of the second straight edge is less than the length of the first segment of the second straight edge; wherein the length of the second segment of the first straight edge is greater than the length of the second segment of the second straight edge; wherein the fourth fabric piece is smaller than the third fabric piece;

wherein the second template can not be formed using the first template; and wherein the first template can not be formed using the second template.

2. The device of claim 1 wherein the first template includes markings or sewing lines running ⅛" to ¼" from the three straight edges.

3. A method of forming a triangle quilting pattern comprising:

cutting an equilateral triangle fabric piece from a first quilting template; wherein the first quilting template has a equilateral triangle shape;

cutting a first isosceles trapezoid fabric piece from a second quilting template; wherein the second quilting template has a isosceles trapezoid shape;

sewing the first isosceles trapezoid fabric piece to a first side of the equilateral triangle fabric piece;

cutting a second isosceles trapezoid fabric piece from the second quilting template; wherein the second isosceles trapezoid fabric piece is smaller than the first isosceles trapezoid fabric piece; wherein the second quilting template includes a first mark running parallel to the height of the second quilting template that is a cutting guide for cutting the second isosceles trapezoid fabric piece;

sewing the second isosceles trapezoid fabric piece to a second side of the equilateral triangle fabric piece;

cutting a third isosceles trapezoid fabric piece from the second quilting template, wherein the third isosceles trapezoid fabric piece is smaller than the second isosceles trapezoid fabric piece, wherein the second quilting template includes a second mark running parallel to the height of the second quilting template; wherein the second mark is a cutting guide for cutting the third isosceles trapezoid fabric piece; and sewing the third isosceles trapezoid fabric piece to a third side of the equilateral triangle fabric piece.

* * * * *